United States Patent [19]

Fremion

[11] 4,027,817

[45] June 7, 1977

[54] SELF-LOCKING CUSHIONING MEMBER

[75] Inventor: Edwin A. Fremion, West Alexandria, Ohio

[73] Assignee: Westvaco Corporation, New York, N.Y.

[22] Filed: Oct. 4, 1976

[21] Appl. No.: 728,999

[52] U.S. Cl. ..... 229/14 C; 206/320

[51] Int. Cl.[2] ..... B65D 5/50; B65D 25/12; B65D 85/00

[58] Field of Search ..... 229/14 C, DIG. 1; 206/306, 320, 326

[56] References Cited

UNITED STATES PATENTS

| | | | |
|---|---|---|---|
| 3,072,313 | 1/1963 | Suempson | 229/14 C |
| 3,337,111 | 8/1967 | Petriekis et al. | 229/DIG. 1 |
| 3,482,759 | 12/1969 | Ortiz | 229/14 C |
| 3,613,985 | 10/1971 | Goodsite | 229/14 C |
| 3,734,389 | 5/1973 | Brown | 206/320 |
| 3,780,929 | 12/1973 | Terrasi | 229/14 C |
| 3,957,158 | 5/1976 | Poggiali | 206/320 |
| 3,957,196 | 5/1976 | Kellerman | 229/14 C |
| 3,982,682 | 9/1976 | Fremion | 229/14 C |

*Primary Examiner*—Davis T. Moorhead

[57] ABSTRACT

The cushioning member of the present invention consists of a pair of legs which become locked together with a frictional fit when folded into their useable configuration. The cushioning member is prepared from a one-piece blank of cut and scored paperboard or the like and is readily produced with the aid of a minimum of folding steps to result in a structure comprising legs formed from multiple layers of the blank material joined by a common central blank portion. The improvement in the invention resides in the fact that the leg structures include strategically located cut-outs and interlocking tab portions which become frictionally engaged with one another when the legs are folded from their normally flat, unassembled condition to a substantially right angle useful condition.

10 Claims, 5 Drawing Figures

SELF-LOCKING CUSHIONING MEMBER

BACKGROUND OF INVENTION

The present invention relates to the field of packaging and more particularly it relates to reinforcing and cushioning elements that are used in the corners of shipping and storage containers to protect the contents of the containers from damage caused by external forces. In particular, the cushioning pad of the present invention is useful as a corner post although it could also be used as an upper or lower edge protecting member in a container.

In the packaging of heavy appliances such as refrigerators, air conditioners, driers and the like, cushioning pads and corner posts are usually provided between the appliance and the shipping container to protect the packaged appliances from damage during transportation and storage. However, during transportation, storage and handling of the packaged proucts, the normally lightweight containers used are subject to damage. Accordingly, to overcome some of the problems inherent with the protection of packaged products, it is customary to add cushioning members to the shipping containers. When provided at the corners of a container, the cushioning members provide excellent stacking strength, and because they provide a space between the side walls of the shipping container and the packaged product, damage to the packaged product from external blows is substantially reduced.

DESCRIPTION OF PRIOR ART

Previously, cushioning members such as corner posts have been made from multiple thickneses of paperboard such as corrugated paperboard with appropriate cuts and scores to be folded into a ninety degree angle and fitted into the corner of a shipping container. In general, each of these configurations have been required to be erected prior to use in the container. The prior art is well developed in such cases as represented by the following list of U.S. Pats.:

Nos. 3,072,313; 3,780,929; 3,613,985; 3,957,196; 3,734,389; 3,982,682.

A careful analysis of the patented corner posts as represented by the above patents will show that most prior art designs take the form of bulky and hard to handle and store completely formed structures, or the form of unfinished blanks from which the corner posts are built on site, or in the case of the corner post disclosed in applicant's prior U.S. Pat. No. 3,982,682, a corner post which is fully assembled but which can still be shipped flat.

In contrast to these prior efforts, the cushioning member structure of the present invention provides the user with a choice, i.e., a completely formed and glued structure, prepared from a minimum amount of material to provide a maximum amount of strength, with a unique self locking feature that needs only one fold to be set-up from its substantially flat condition to its useable configuration, or an unassembled blank which can be set up and assembled for use at the point of use. In either case, i.e., glued or unglued, prior to being set up, the cushioning member of the present invention can be stored in its substantially flat form, and after being set-up, the cushioning member of the present invention remains in its erected form as a result of the unique frictional locking scheme provided in the blank structure.

SUMMARY OF INVENTION

The cushioning member of the present invention is prepared from a single blank of paperboard or the like with a minimum of folding steps and with or without the application of adhesive. The blank is suitably cut and scored by the manufacturer to provide the self locking elements with the arrangement and location of the scores and cuts being dictated by the size and ultimate shape of the desired cushioning member configuration. Thus, the final cushioning member is comprised of two legs formed from multiple layers of the blank material joined by a common substantially central blank portion.

Corrugated paperboard is the preferred blank material and generally the blank is formed from several layers of paperboard (corrugated medium and linerboard) to produce a structure of adequate strength. The corrugated material may be that conventionally used in forming the shipping containers or it may be impregnated or coated with a suitable moisture barrier material to resist the penetration of water. In the preferred embodiment the cushioning member blank is generally of rectangular configuration with parallel top and bottom edges and parallel lateral side edges, and is divided laterally by a plurality of substantially parallel fold lines into six major panels. The panels are further arranged into two pairs of three each by a more-or-less centrally located score line. It should be understood, however that while two pairs of three panels each is shown as the preferred embodiment, the corner post actually only requires a minimum of two panels in each pair in order to achieve the desired self locking feature. Thus, the number of panels in each pair of panels over the minimum of two depends upon the overall thickness of the blank material that is used. The three panels on each side of the generally centrally located score line have substantially the same width, only varying in width as related to the thickness of the blank material and because of the fact that the three panels on each side of the central score are folded one on top of the other to form the multiple layers for each cushioning member leg. The generally centrally located score line is only so oriented when the two legs of the cushioning member are of substantially the same width. When one leg is to be wider than the other, the central score is offset on the blank to the left or right accordingly.

The cushioning member blank also includes a plurality of spaced apart and strategically located cut outs which ultimately form the unique leg locking elements of the present invention. For this purpose, a first set of cut outs are located along the score which separates the first two panels on one side of the centrally located score line, a second set are diametrically offset from and spaced between the first set and located along the score separating the first two panels on the other side of the centrally located score line, and a third set are arranged along one edge of the centrally located score and correspond in diametrical location to either the first or second set of cut outs. The score lines between the first and second panels of each three panel set, and for that matter, the score lines between the second and third panels of each three panel set are preferably doubled, or spaced apart slightly, once again to accommodate the thickness of the blank material and to permit a smooth folding sequence. In addition, where corrugated paperboard is used as the blank material, the direction of the corrugations is either oriented perpendicular to the score lines to facilitate the folding sequence, or parallel to the scores to provide maximum stacking or compressive strength to the cushioning member.

The arrangement, location and size of the cut outs in the blank provide when the blank is folded, a plurality of tongue and slot elements for the legs of the cushioning member which become frictionally engaged when the cushioning member is set up. Thus, once the cushioning members are erected and placed in a shipping container, they retain their desired shape until such time that the product is loaded. Prior to use, the cushioning members can be stored in their substantially flat un-erected condition.

DETAILED DESCRIPTION

Figure 1:
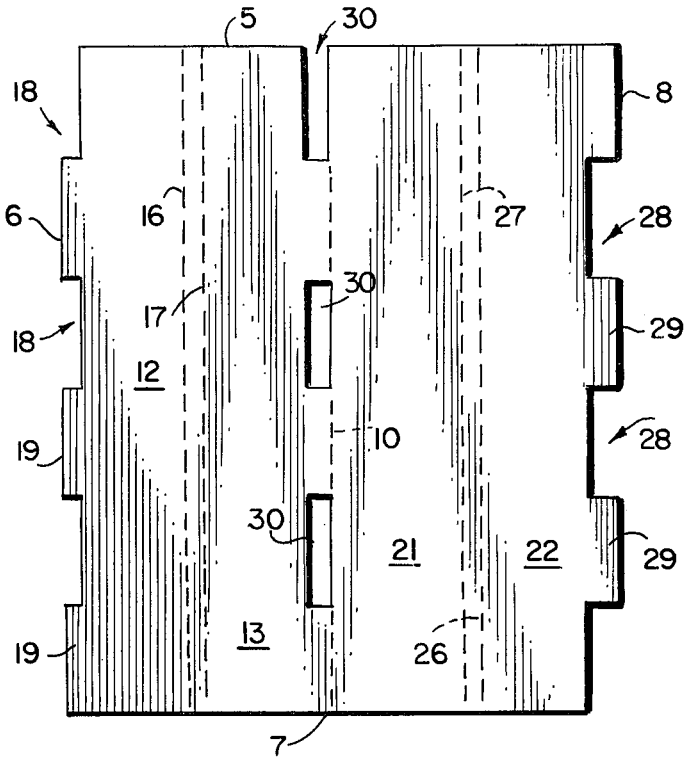
FIG. 1 shows in plan a typical blank structure for use in constructing the cushioning member of the present invention.

Referring to the drawing, and in particular to FIG. 1, there is illustrated a blank of corrugated paperboard or the like that is cut and scored for the purpose of preparing the cushioning member of the present invention. The blank is of substantially rectangular configuration having parallel top and bottom edges 5, 7 and opposed parallel lateral edges 6, 8. In the embodiment shown in FIG. 1, the blank is divided into two pairs of leg forming panels 12, 13 and 21, 22 separated by a common score line 10. Obviously the blank could comprise additional leg forming panels, particularly as shown in FIG. 2, however, for the purpose of the present invention, a minimum of two leg forming panels are required on each side of the score 10 in order to achieve the unique leg locking function.

The leg forming panels are further divided from one another by paired score lines 16, 17 between panels 12, 13, and score lines 26, 27 between panels 21, 22 respectively. The size of the leg panels 12, 13 and 21, 22 is determined primarily by the desired size of the legs of the cushioning member. Thus, where the cushioning member legs are to be of the same width, the score line 10 would lie substantially centrally of the blank. However, it has been found to be desirable to make the legs of different width, thus the score line 10 is offset to one side of center accordingly. For the sake of this description, score line 10 divides the blank into panels 12, 13 which form a left leg 31 and panels 21, 22 which form a right leg 32. The width of panel 12 from edge 6 to score line 16 determines the width of left leg 31, and the width of panel 22 from edge 8 to score line 26 determines the width of right leg 32. Each of panels 13 and 21 are increased in width over their respective attached panels 12 and 22 by an amount substantially equal to the thickness of the blank material to accommodate the folding sequence. Similarly, scored lines 16, 17 and 26, 27 are spaced apart a distance equal to approximately twice the thickness of the blank material to accommodate the folding sequence.

The spacing of the cutouts 18, 28 and 30 in the blank is not critical except that they should be sufficiently close to one another to provide an efficient locking action. The compression strength of the cushioning member is reduced the same whether there is one or more cutouts. The size of the cutouts 18, 28 and 30 is determined by the thickness of the blank material and the ultimate folding sequence which locks one leg into the other. Since the blank shown in FIG. 2 is preferred for the present invention, a detailed description of that blank with the size and location of the cutouts follows.

Figure 2:
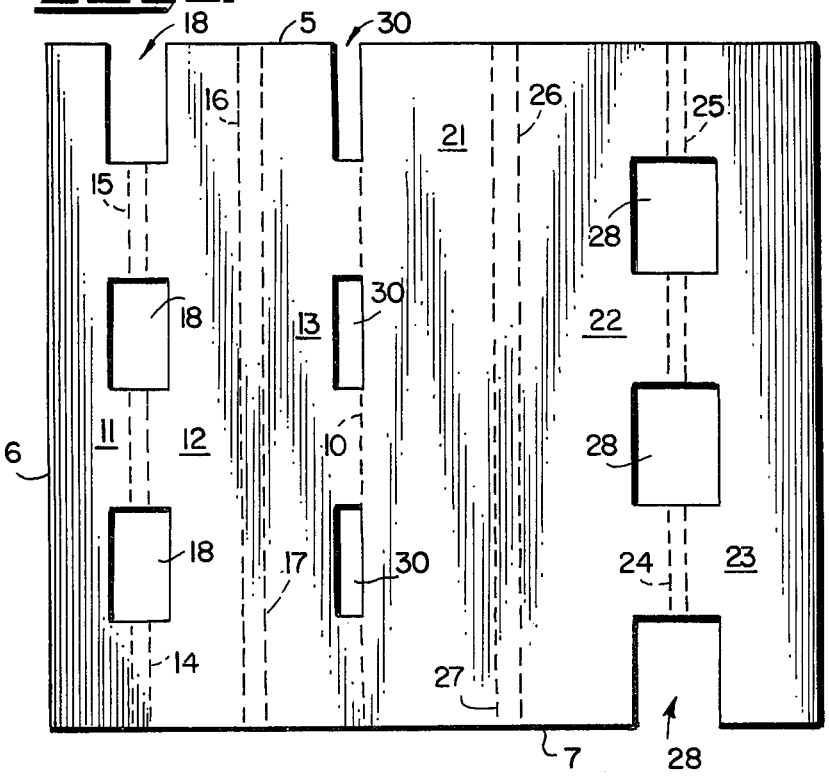
FIG. 2 is a view similar to FIG. 1 showing a second embodiment of the blank for the present invention.

As will be seen in FIG. 2, the blank consists of the same panels previously described with respect to FIG. 1 with the addition of two outer panels 11 and 23 attached to panels 12 and 22 respectively. The additional outer panels 11 and 23 are separated respectively from panels 12 and 22 by spaced apart paired fold lines 14, 15 and 24, 25. The purpose of the additional panels 11, 23 is to provide cushioning member legs 31 and 32 with sections of triple the blank thickness. The width of panels 11 and 23 is substantially one blank thickness less than their attached panels 12, and 22, and each further includes a mirror likeness of the cutouts 18, 28 previously described for panels 12 and 22. Accordingly, as noted in FIG. 3 (which represents the blank of FIG. 2 after one fold), the overall shape so achieved is substantially identical to that shown in FIG. 1. Thus, FIGS. 1 and 3 represent comparable examples of the blank for making the cushioning member of the present invention except for the increased thickness of the leg forming panels in FIG. 3.

Figure 3:
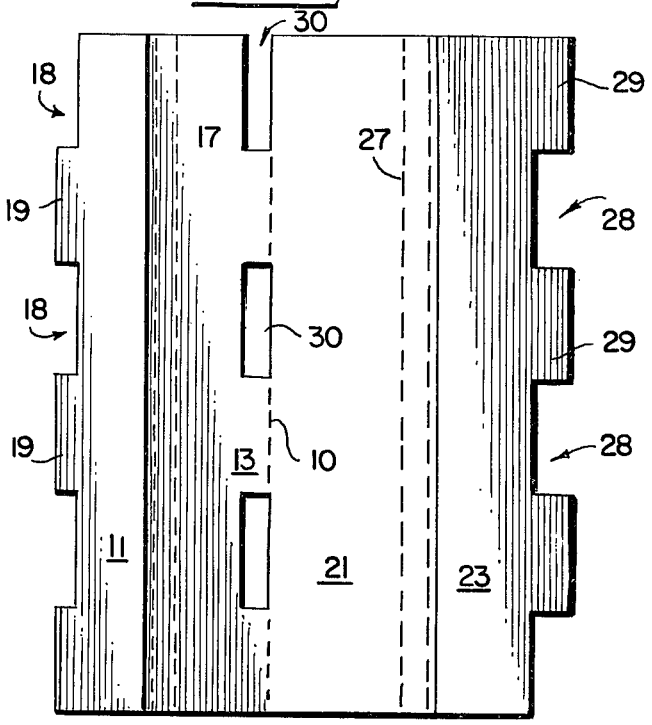
FIG. 3 shows the blank of FIG. 2 after a first folding step.
Figure 4:
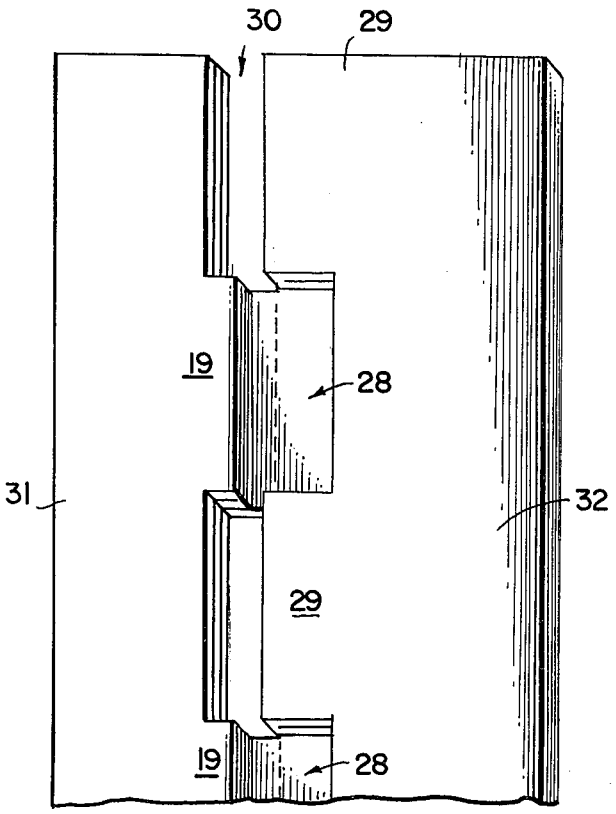
FIG. 4 is a partial view in perspective of the blank of FIG. 2 after a second folding step; and, FIG. 5 is a partial view in perspective of the final cushioning member prepared from the blank of FIG. 2.
Figure 5:
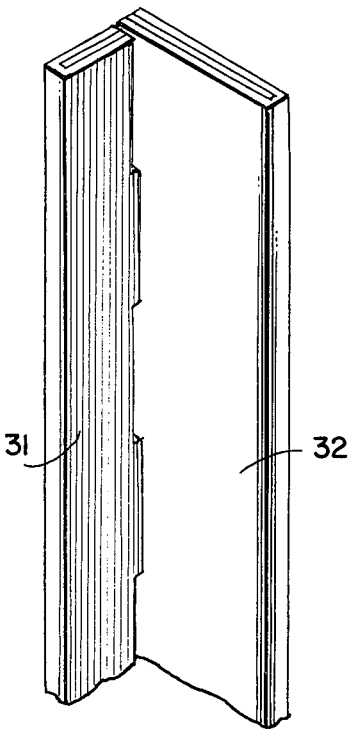

Referring then to FIGS. 1 and 3, it will be seen that the cutouts 18 and 28 define and determine the size of the locking tongues 19 and 29 respectively, with the opposed locking tongues and cutouts, i.e., 19, 28 and 29, 28 being of substantially the same size to provide a close, locking friction fit. Moreover, as shown in each of FIGS. 1, 2, and 3, the cutouts 30 are applied in the blank to the panel 13 on the left of score line 10 in such a manner as to become aligned with the cutouts 18 in left leg 31 and the locking tongues in right leg 32. This particular arrangement provides for a folding sequence where the right leg becomes locked into the left leg, particularly as shown in FIGS. 4 and 5. If the cutouts along score line 10 were located in panel 21 on the right of score line 10, they would be reoriented to align with cutouts 28 and locking tongues 19 to produce a cushioning member where the left leg would be locked into the right leg.

As regards the size of the cutouts in the blank shown in FIG. 2, those at 30 are of a width equal to about twice the thickness of the blank material in order to accommodate the locking tongues 29. For a corrugated paperboard blank of nominal thickness of about one-fourth inch, the cutouts 30 are preferably about five-eighths inch wide in order to accept the folded, double thick tongues 29. Obviously the length of cutouts 30 would be substantially the same as the width of tongue members 29. With the blank of FIG. 2 folded as shown in FIG. 3, the depth of the cutouts 18 is equal to about one-half inch or twice the thickness of the blank material. This depth is required so that when panels 11 and 12 are folded over as shown in FIG. 4, the space so created will accommodate the double thick tongue members 29. Finally, since the locking tongues 29 must be long enought to fit into the cutouts at 30, the cutouts at 28 which form tongue members 29 must have a depth as shown in FIG. 3 equal to about three-fourths inch for a blank of nominal one-fourth inch thickness, or three times the thickness of the blank material. Obviously, the length of the cutouts must be correlated with one another to achieve a close, frictional fit when the cutouts are engaged with the tongue members.

FIGS. 4 and 5 illustrate the blank of FIG. 2 after the second folding step which forms the left and right legs 31, 32 and the final cushioning member. These Figures clearly show the criticality of the size and location of the cutouts and locking tongues required for a good frictional lock. When so folded, each leg 31, 32 is made up of triple thick sections of the blank. Thus when right leg 32 is locked into left leg 31, the locking tongues 29 must have a length equal to one blank thickness greater than the tongues 19 to produce an effective lock. It is conceivable that each of panels 11 and 23 in FIG. 2 could be of substantially less width than their attached panels 12 and 22, however, normally they are of a width equal to that of the panels at 12 and 22 less one blank thickness. Also in FIG. 2, the score lines 14, 15 and 24, 25 are nominally spaced apart a distance equal to approximately twice the thickness of the blank material in order to accommodate the first folding step. Meanwhile, score lines 16, 17 and 26, 27 in FIG. 2 are spaced apart a distance equal to about three times the thickness of the blank material for the same reason.

The blank is preferably die cut and scored in sheet form and either shipped in the unglued and flat condition to the user for final assembly or glued before shipment. Where the blank is shipped in flat form, the user then need only make the necessary folds to achieve the final configuration. If the blank is preglued, one glue step can be used with either of the blanks in FIGS. 1 or 2. If the blank of FIG. 2 is used, a single glue step, which applies adhesive to the upper surfaces of panels 12, 13, 21 and 22, and two folds about the scores at 14, 15 and 24, 25, then at scores 16, 17 and 26, 27 are made to achieve a blank as shown in FIG. 4. The blanks can be cut to the proper length at 5, 7 by the manufacturer or shipped to the user in any desired length which can later be cut after the cushioning member is formed. It will thus be seen that a unique self locking cushioning member has been disclosed which may be used as a corner post or horizontally disposed pad for securely and safely packaging objects in a suitable container. While only two possible embodiments of the invention have been fully disclosed in detial, it will be understood by those skilled in the art that other modifications could be made without departing from the spirit and scope of the invention as defined in the appended claims.

I claim:

1. A self locking cushioning member formed from a blank of foldable sheet material comprising:

a. a substantially rectangular sheet of said material formed from several layers of said material having parallel top and bottom edges and opposed parallel lateral edes perpendicular to said top and bottom edges;

b. a first score line extending from said top to said bottom edge located substantially centrally of said sheet of material and dividing said sheet laterally into a plurality of leg forming panels;

c. a first pair of leg forming panels on each side of said first score;

d. at least one additional pair of leg forming panels foldably connected to the laterial free edges of said first pair of leg panels;

e. a first set of cut outs in said sheet material located along the lateral free edges of each of said additional pair of leg forming panels which provide a plurality of first tongue elements;

f. a second set of cut outs in said sheet material located along the lateral free edges of the other of said additional pair of leg forming panels, said second set of cutouts being equally spaced between the first set of cutouts to provide a plurality of second tongue elements that are diametrically offset from said ffirst tongue elements;

g. a third set of cutouts in said sheet material arranged along one side of said first score line and corresponding in diametrical location to one of the first or second set of cutouts.

2. The cushioning member of claim 1 wherein the leg forming panels on one side of said first score line are folded together to form a first leg member and the leg forming panels on the other side of said first score lin are folded together to form a second leg member.

3. The cushioning member of claim 2 wherein the first tongue elements align with and fit into the second set of cutouts and the second tongue elements align with and fit into the first set of cutouts.

4. The cushioning member of claim 3 wherein one of said first or second set of tongue elements align with and fit into the third set of cutouts to lock said first and second leg members together.

5. The cushioning member of claim 4 wherein a second additional pair of leg forming panels are foldably attached to the lateral free edges of said one additional pair of leg forming panels.

6. The cushioning member of claim 5 wherein said first and second set of cutouts are duplicated in said second additional pair of leg forming panels along the attached edges between said second and one additional pair of leg forming panels.

7. The cushioning member of claim 6 wherein the foldable connections between said first pair of leg forming panels and said one additional pair of leg forming panels and said one additional pair of leg forming panels and said second additional pair of leg forming panels comprises paired parallel score lines, separated from one another by a multiple of the thickness of the blank sheet material.

8. The cushioning member of claim 7 wherein said first and second leg members are of different width and the panels forming each leg beginning at the first score line are of substantially the same width on each side of the first score line.

9. The cushioning member of claim 8 wherein the leg forming panels on each side of said first score line are folded over and adhered to one another.

10. The cushioning member of claim 9 wherein the blank sheet material comprises alternating layers of corrugated medium and linerboard.

* * * * *